US012180862B2

(12) United States Patent
Karl

(10) Patent No.: US 12,180,862 B2
(45) Date of Patent: Dec. 31, 2024

(54) VALVE TRAIN DEVICE

(71) Applicant: KTM AG, Mattighofen (AT)

(72) Inventor: Tobias Karl, Frankenmarkt (AT)

(73) Assignee: KTM AG, Mattighofen (AT)

( * ) Notice: Subject to any disclaimer, the term of this patent is extended or adjusted under 35 U.S.C. 154(b) by 0 days.

(21) Appl. No.: 18/415,051

(22) Filed: Jan. 17, 2024

(65) Prior Publication Data

US 2024/0247599 A1 Jul. 25, 2024

(30) Foreign Application Priority Data

Jan. 19, 2023 (AT) ..... A 50025/2023

(51) Int. Cl.

| | |
|---|---|
| ***F01L 1/047*** | (2006.01) |
| ***F01L 1/08*** | (2006.01) |
| ***F01L 13/00*** | (2006.01) |
| *F01L 1/344* | (2006.01) |
| *F01L 7/18* | (2006.01) |

(52) U.S. Cl.

CPC ..... *F01L 1/047* (2013.01); *F01L 1/08* (2013.01); *F01L 13/0036* (2013.01); *F01L 2001/0473* (2013.01); *F01L 1/34413* (2013.01); *F01L 7/18* (2013.01); *F01L 2013/0052* (2013.01); *F01L 2013/111* (2013.01); *F01L 2800/11* (2013.01); *F01L 2800/14* (2013.01); *F01L 2820/041* (2013.01)

(58) Field of Classification Search

CPC ..... F01L 1/047; F01L 2001/0473; F01L 1/08; F01L 1/34413; F01L 13/0036; F01L 2013/0052; F01L 2013/111; F01L 2800/11; F01L 2800/14; F01L 2820/041

USPC ..... 123/90.18

See application file for complete search history.

(56) References Cited

U.S. PATENT DOCUMENTS

| | | | | |
|---|---|---|---|---|
| 9,605,603 | B2 | 3/2017 | Glugla et al. | |
| 10,329,971 | B2 | 6/2019 | Verner et al. | |
| 10,954,869 | B1 * | 3/2021 | Zhang | F02D 13/0246 |
| 2014/0303873 | A1 | 10/2014 | Glugla et al. | |
| 2018/0258803 | A1 | 9/2018 | Verner et al. | |
| 2018/0340484 | A1 * | 11/2018 | Stewart | F02D 41/222 |
| 2019/0301902 | A1 * | 10/2019 | Kataoka | F02M 55/005 |
| 2021/0071549 | A1 * | 3/2021 | Ciola | F01L 1/053 |
| 2022/0148781 | A1 * | 5/2022 | Rigling | H01F 7/121 |

FOREIGN PATENT DOCUMENTS

| | | |
|---|---|---|
| CN | 215057629 | 12/2021 |
| CN | 215057629 U * | 12/2021 |
| DE | 10 2010 012 470 | 9/2011 |

(Continued)

*Primary Examiner* — Jorge L Leon, Jr.

(74) *Attorney, Agent, or Firm* — Wenderoth, Lind & Ponack, L.L.P.

(57) ABSTRACT

A valve train device includes a shaft having one or more actuation contours for actuating at least one actuation element of a valve of a combustion engine, and the actuation contours being arranged on the shaft so as to rotate therewith. A sensor unit including one or more sensors is provided, and each of the one or more sensors has a spatial sensing area for sensing a physical variable. In at least one axial position, an actuation contour of the one or more actuation contours is arranged at least partially in the spatial sensing area of a sensor of the one or more sensors.

31 Claims, 4 Drawing Sheets

(56) References Cited

FOREIGN PATENT DOCUMENTS

| | | | | |
|---|---|---|---|---|
| DE | 10 2011 056 833 | | 6/2013 | |
| DE | 102013210487 | A1 * | 12/2014 | ..... F01L 1/053 |
| DE | 10 2018 104 422 | | 9/2018 | |
| DE | 10 2017 216 752 | | 3/2019 | |
| DE | 10 2021 107 325 | | 9/2021 | |
| WO | 2017/069101 | | 4/2017 | |
| WO | WO-2017069101 | A1 * | 4/2017 | ..... F01L 13/00 |

* cited by examiner

VALVE TRAIN DEVICE

BACKGROUND OF THE INVENTION

The invention relates to a valve train device with at least one shaft. A number of (one or more) actuation contours for actuating at least one actuation element of a valve of a combustion engine is arranged on the at least one shaft so as to rotate therewith. A sensor unit including a number of (one or more) sensors is provided, and each sensor of the number of sensors has a spatial sensing area for sensing a physical variable. The invention further relates to a combustion engine with at least one valve and at least one valve train device, and to a motorcycle with a combustion engine. In addition, the invention relates to a method for determining the axial and/or rotational position of at least one actuation contour for actuating at least one actuation means of a valve of a combustion engine by means of a valve train device.

Valve train devices with actuation contours, in particular cams, that are fastened to a shaft (camshaft) in an axially displaceable manner and so as to rotate therewith are known from the state of the art. Typically, at least two actuation contours are arranged on a slide in different axial areas, and the actuation contours differ from one another. Through the axial displacement of the slide and the actuation contours arranged thereon, one of the at least two actuation contours can be brought into engagement with an actuation means of an engine valve. As a result of the different actuation contours, an actuation element of the engine valves can be actuated differently depending on the active actuation contour. In particular, two different actuation profiles can be implemented on the basis of the phase angle.

When a first actuation contour engages, the engine valve can be opened further or for longer than when a second actuation contour engages. Just one actuation contour can be provided, wherein the actuation means of the engine valves is either actuated by the actuation contour or is not actuated at all.

The printed document DE 10 2011 056 833 A1 reveals a valve train device for a combustion engine. The valve train device has a shaft as well as a first and a second slide, which are arranged on the shaft so as to rotate therewith and in an axially displaceable manner. A reluctor with a different number of lugs is arranged in each case on the first slide and on the second slide. A reluctor with gaps is arranged on the shaft. Depending on the axial position of the slides, different lugs are driven into the gaps. A sensor arranged above the reluctor with the gaps can contactlessly determine the axial position of the first slide and of the second slide by evaluating the gap-lug pattern. Advantageously, this can be implemented using a single sensor. The radial position of the shaft can likewise be determined.

The printed document US 2014/0303873 A1 reveals a valve train device for a combustion engine, having a slide with two actuation contours. In addition, two adjacent, different encoder contours are arranged on the slide and are arranged in the sensing area of a sensor. The sensor can determine which actuation contour is active. A further sensor on the shaft (camshaft) can determine the phase of the shaft relative to the crankshaft.

Also known are single-channel sensors with a separate mechanical contour on the slide, using which the position of the slide can be detected.

A disadvantage of the state of the art is that encoder contours have to be provided or a separate mechanical device is needed on the slide. Particularly in the case of use in motorcycle engines, this is not always possible due to the lack of space. In addition, a large number of components are needed, resulting in higher costs.

SUMMARY OF THE INVENTION

An object of the invention is to create a space-saving and component-saving option for determining the rotational position and/or the axial position of actuation contours for actuating at least one actuation element of a valve of an internal combustion engine.

According to the invention, in at least one (e.g., a first) axial position, at least one (e.g., a first) actuation contour of a number of (one or more) actuation contours is arranged at least partially in the spatial sensing area of at least one (e.g., a first) sensor of a number of (one or more) sensors.

Since, in at least one axial position, the at least one actuation contour is arranged in the spatial sensing area of at least one sensor, the presence of the actuation contour in the sensing area of the at least one sensor can be detected. Thus, a conclusion can be drawn on the axial position of the at least one actuation contour.

In addition, the shape of the actuation contour can be determined if the time curve of the physical variable induced by the rotation of the actuation contour is analyzed. For example, different shapes of the actuation contour can induce different pulse widths in the time curve of a signal brought about by the physical variable.

The rotational position of the actuation contour can also be determined, for example by way of the magnitude of the physical variable, or the phase of the actuation contour relative to the crankshaft can be determined, for example by way of the position of the pulses over time.

Preferably, the spatial sensing area of the at least one sensor of the number of sensors is arranged in a limited axial area. Thus, a conclusion can be drawn on an axial position of the number of actuation contours from the detection of the presence of an actuation contour in the sensing area.

The sensing area can be more limited than the sensing area that is physically possible. Preferably, the spatial sensing area of the at least one sensor of the number of sensors corresponds to the spatial area in which the presence of at least one actuation contour induces the measurement of the physical variable above a particular (predetermined) threshold value. The determination of whether or not a threshold value has been exceeded can be carried out in particular in an evaluation unit.

The number of sensors and/or actuation contours can be one, two or more.

The one or more actuation contours are associated with the shaft so as to rotate with the shaft. For example, as noted above in the discussion of the background of the invention, the one or more actuation contours can be arranged on (i.e., directly on) the at least one shaft to rotate with the shaft. In a preferred embodiment, however, at least one slide is mounted on the shaft in an axially displaceable manner and so as to rotate therewith, and the one or more actuation contours are arranged on the at least one slide. In particular, the actuation contours of the one or more actuation contours are mounted so as not to be displaceable relative to one another.

Alternatively, the shaft is mounted displaceable in relation to the actuation element of the valve of an internal combustion engine and the number of actuation contours are preferably arranged directly on the shaft.

In a preferred embodiment, in at least one axial position, each actuation contour of the number of actuation contours can abut the at least one actuation element of the valve of the internal combustion engine. By different axial positions being adopted, different actuation contours can actuate the actuation element, as a result of which a valve of the internal combustion engine can be operated in different ways.

Preferably, the sensor unit is fixed in relation to a cylinder head of an internal combustion engine. Thus, by displacing the number of actuation contours, a different actuation contour can be brought into engagement with the actuation element in each case.

The number of sensors can be arranged on a shared printed circuit board of the sensor unit and/or can be arranged in a shared housing of the sensor unit. Thus, a particularly compact and cost-effective design is obtained.

In a preferred embodiment, in at least one axial position and at least one rotational position, the at least one (e.g., the first) actuation contour of the number of actuation contours is arranged at a distance of less than 10 mm, preferably less than 5 mm, and particularly preferably less than 2.5 mm, from at least one (e.g., the first) sensor of the number of sensors. In this position, the actuation contour is preferably in the sensing area of the sensor. This distance can be adopted in the rotational position in which a "lobe" of the actuation contour is arranged facing the sensor.

In a preferred embodiment, the at least one (e.g., the first) sensor of the number of sensors is formed as a contactless sensor. An electromagnetic field, for example a magnetic field, an electrical field or an electromagnetic wave comes into consideration as physical variable which is sensed by the sensor, for example.

Preferably, the at least one (e.g., first) sensor of the number of sensors can be formed as a magnetic-field sensor, in particular a Hall effect sensor, preferably wherein a magnetic field generated by the at least one (e.g., first) actuation contour and/or influenced by the at least one actuation contour can be sensed in the sensing area by the at least one (e.g., first) sensor.

In a preferred embodiment, the presence and/or the shape and/or the rotational position and/or the phase of at least one actuation contour of the number of actuation contours can be detectable in the sensing area of a sensor of the number of sensors by said sensor, in particular together with an evaluation unit.

Detecting the "presence" of at least one actuation contour means determining whether an actuation contour is arranged in the sensing area.

Detecting the "shape" of at least one actuation contour allows a conclusion to be drawn on which actuation contour is in the sensing area.

Detecting the "rotational position" of at least one actuation contour allows a conclusion to be drawn on the rotational position of the actuation contour, in particular relative to the crankshaft. In particular, it can be a static rotational position.

By "phase" is meant the phase of the rotation of the (cam) shaft, for example in relation to the crankshaft.

A physical variable that varies on the basis of the presence and/or shape and/or rotational position and/or phase of the at least one actuation contour located in the sensing area can be measured by the at least one sensor.

In particular, a, preferably electrical, signal that is dependent on the physical variable can be transmitted to an evaluation unit, wherein the signal, in particular the time curve of the signal, can be evaluated by the evaluation unit.

The evaluation unit can be configured to draw a conclusion on (i.e., determine) an axial position and/or a rotational position of the at least one actuation contour, preferably by evaluating a strength and/or pulse lengths of the signal.

By way of example, the presence of a particular strength of the signal, in particular of an average or a maximum, can lead to a conclusion on the presence of an actuation contour in the sensing area and thus on the axial position of the actuation contour. A conclusion can also be drawn on a rotational position of the at least one actuation contour since the strength may be higher or lower depending on the rotational position.

By way of example, a conclusion can be drawn on the shape of an actuation contour by a pulse length of the signal so that it can be determined which actuation contour is arranged in the sensing area. A conclusion can also be drawn on a phase of the actuation contour, for example relative to the crankshaft, by means of the pulse length.

In a particularly preferred embodiment, the axial distance between two sensors of the number of sensors is greater than the axial width of at least one actuation contour of the one or more actuation contours. Thus, a "dead area" is created between two sensing areas of the two sensors. Due to the axial distance of the sensing areas from at least one actuation contour, an actuation contour can be arranged between two sensing areas without itself being sensed.

In particular, in such a situation, two actuation contours can be provided such that a first actuation contour is arranged in the sensing area of a sensor and a second actuation contour is arranged in the dead area.

Additionally or alternatively, the axial distance between two sensors of the number of sensors is less than the axial width of two adjacent actuation contours of the number of actuation contours.

In the dead area between the two sensing areas, therefore, there is not enough space for two actuation contours.

An error message can be output by an evaluation unit for the sensor signals if at least two, preferably the two, sensors detect the presence of an actuation contour in their sensing area.

This is advantageous particularly when two adjacent actuation contours are provided, wherein the sensing areas of two sensors are at a distance that is less than the axial width of the two actuation contours. This results in an incorrect intermediate position in which in each case an actuation contour is arranged at least in part in a sensing area. In an intermediate position such as this, both sensors detect the presence of an actuation contour in their sensing area.

It is particularly preferable that the number of actuation contours can adopt a first axial position and a second axial position relative to the sensor unit. In particular, this first and second axial position can be adopted during normal operation. An axial position therebetween can be adopted only in the case of incorrect functioning.

In one embodiment, in the first axial position, at least one actuation contour of the number of actuation contours is arranged in the sensing area of at least one sensor of the number of sensors and, in the second axial position, it is arranged outside the sensing area of said at least one sensor. By determining the presence of the at least one actuation contour in the sensing area, a conclusion can be drawn on the axial position.

It is particularly preferable that the number of sensors comprises, in particular consists of, a first sensor with a first sensing area and a second sensor with a second sensing area. In particular, in this case, the first sensor and the second sensor are arranged such that the first and the second sensing areas occupy different spatial areas at least in part. In this way, the presence of an actuation contour can be detected in a plurality of areas, for example.

In a possible embodiment, in the first axial position, at least one actuation contour of the number of actuation contours is arranged in the sensing area of the first sensor and, in the second axial position, it is arranged in the sensing area of the second sensor.

In a preferred embodiment, the number of actuation devices comprises a first actuation device and a second actuation device. It is particularly preferable in this case that the shape of the first actuation device is different from the shape of the second actuation device.

In a possible embodiment, in the first axial position, the second actuation contour is arranged in the sensing area of at least one sensor of the number of sensors and, in the second axial position, the first actuation contour is arranged in the sensing area of said at least one sensor.

In a particularly preferred embodiment, in the first axial position the first actuation contour is arranged in the sensing area of the first sensor and/or, in the first axial position, the second actuation contour is arranged outside the sensing area of the second sensor.

Additionally or alternatively, in the second axial position, the second actuation contour is in the sensing area of the second sensor and/or, in the second axial position, the first actuation contour is outside the sensing area of the first sensor.

If the first sensor detects the presence of an actuation contour (the first one), it can be concluded therefrom that the position is the first axial position. In addition, for it to be determined that the position is the first axial position, the second sensor must not detect the presence of any actuation contour.

If the second sensor detects the presence of an actuation contour (the second one), it can be concluded therefrom that the position is the second axial position. In addition, for it to be determined that the position is the second axial position, the first sensor must not detect the presence of any actuation contour.

If both the first and the second sensor detects the presence of an actuation contour (the first one and the second one, respectively), the position is an incorrect intermediate position, and an error message can be output and/or the engine can be stopped.

In particular, in the context of the above paragraphs, the second actuation contour can abut the at least one actuation element in the first axial position and/or the first actuation contour can abut it in the second axial position.

In particular, the actuation means is arranged in an axial area between the two sensors, in particular between their sensing areas. The active actuation contour actuating the actuation means is thus the actuation contour that is not currently located in any sensing area.

In a method according to the invention for determining the axial and/or rotational position of at least one actuation contour for actuating at least one actuation means of a valve of an internal combustion engine by means of a valve train device, the following method steps are provided:

- detecting at least one physical variable, in particular a magnetic field, using at least one sensor of a number of sensors, wherein the at least one physical variable is influenced by the actuation contour located in the spatial sensing area of the at least one sensor, in particular by the presence, shape, phase and/or rotational position thereof,
- the at least one sensor emits a, preferably electrical, signal based on the at least one detected physical variable to an evaluation unit,
- the signal, preferably a strength and/or at least a pulse length of the signal, is evaluated by the evaluation unit,
- a conclusion is drawn on the axial and/or rotational position and/or phase of the at least one actuation contour.

BRIEF DESCRIPTION OF THE DRAWINGS

Further embodiments and details can be taken from the figures, in which.

DETAILED DESCRIPTION OF THE INVENTION

Figure 1:
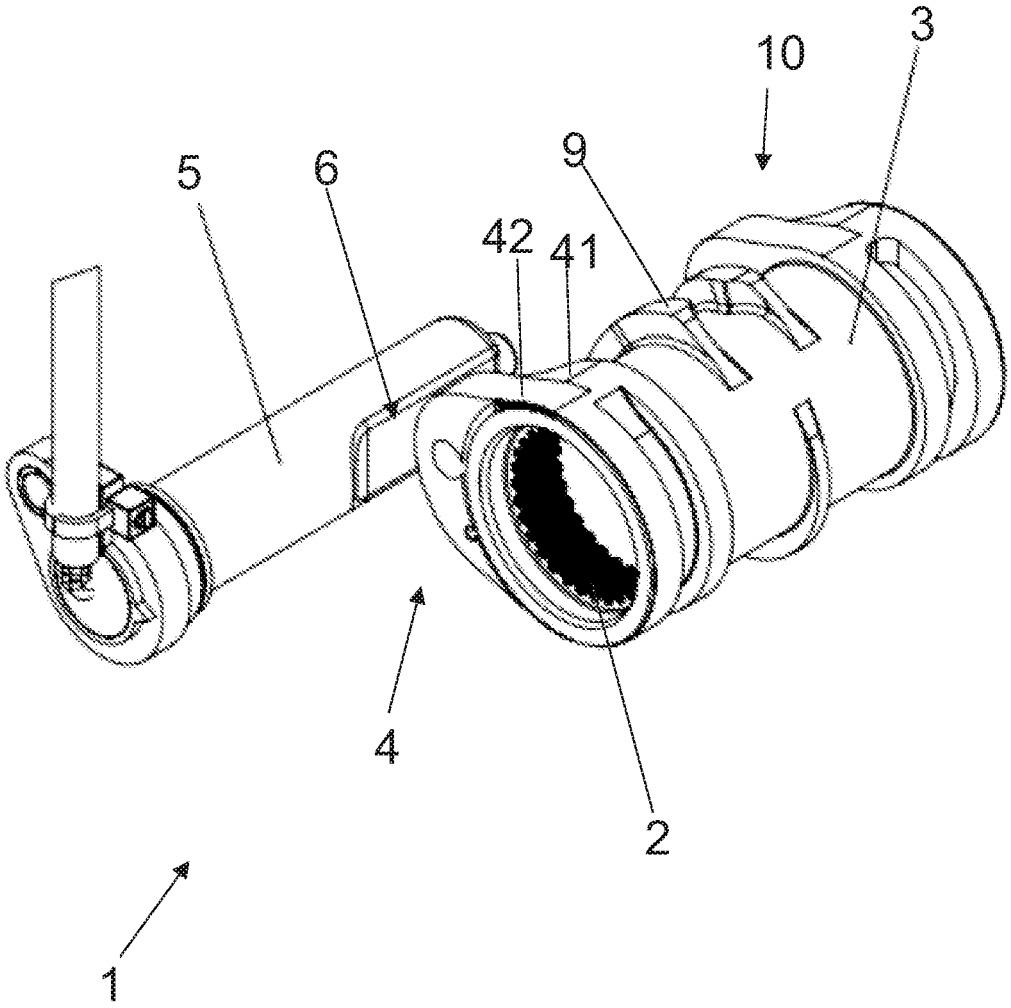
FIG. 1 shows a valve train device with a sensor unit and a slide in a perspective representation.

FIG. 1 shows a valve train device 1 with a sensor unit 5 and a slide 3 in a perspective representation.

On the inside, the slide 3 has a spline 2, by which the slide 3 can be mounted on a shaft (or camshaft, not represented) in an axially displaceable manner and so as to rotate therewith.

The slide 3 has a number of (one or more) actuation contours 4, by which an actuation element 7 of a valve of an internal combustion engine can be actuated. In particular, the actuation contours 4 are shaped as a cam with a projection.

In particular, in this embodiment, two actuation contours 41, 42 are provided at a first end of the slide 3, as can be better seen in FIGS. 2*a* to 6*b*. In addition, a further pair of actuation contours is provided at the second end of the slide 3.

Instead of on a slide 3 as in FIG. 1, the actuation contours 4 can in principle also be arranged directly on the shaft, and the shaft can then be mounted in an axially displaceable manner. In both cases, the actuation contours 4 (i.e., the pair of actuation contours 41, 42) can be axially displaced, either with the slide 3 or with the shaft.

The slide 3 has a selector gate 9, by which the slide 3 can be displaced between two axial positions A1 and A2, for example by an operating pin (not shown).

FIG. 1 also shows a sensor unit 5. The sensor unit 5 is arranged next to the slide 3 and has a number of (one or more) sensors 6 on the side facing the slide 3. The sensor unit 5 has a housing, and the number of sensors 6 are arranged in the housing. Corresponding, preferably electrical, connection elements connect the sensor unit to the internal combustion engine, for example with a central control unit of the vehicle.

In particular, at least one sensor 6 faces the actuation contours 4, 41, 42 (in this embodiment, the pair of actuation contours 41, 42) such that the pair of actuation contours 41, 42 can be arranged in a sensing area 8 of the at least one sensor 6.

The further actuation contours 10 in the embodiment of FIG. 1 are not arranged in the sensing area 8 of the first sensor 6 and are not detected. A sensing of the further actuation contours 10 is not absolutely necessary since the axial position A1, A2 of the slide 3 can also take place solely by the detection of the pair of actuation contours 41, 42.

Figure 2A:
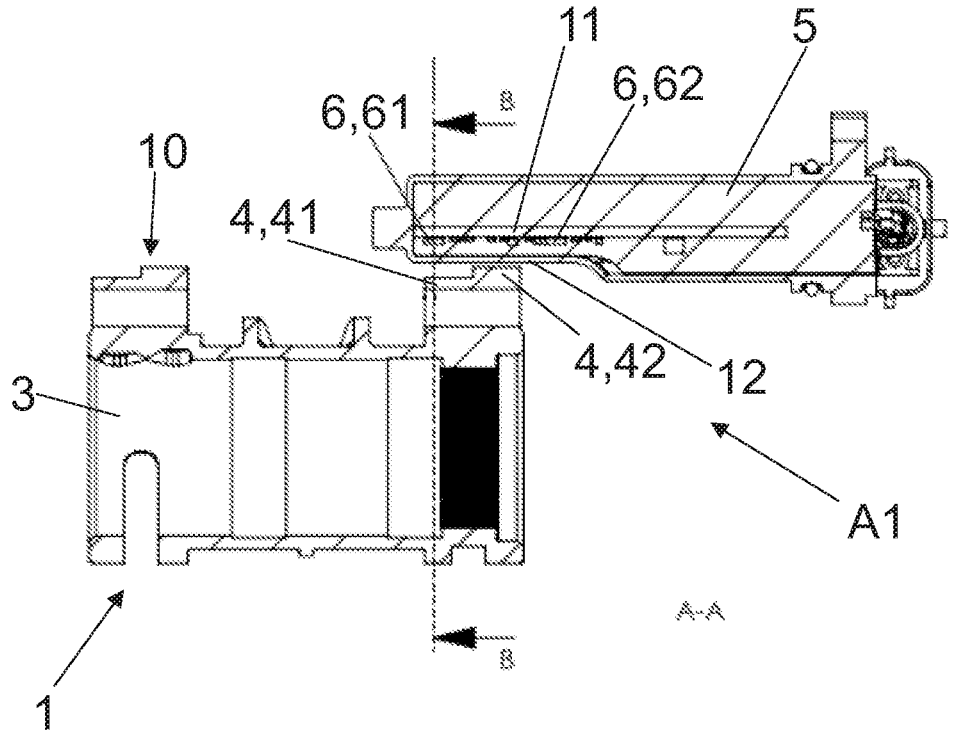
FIG. 2*a* shows a valve train device with a sensor unit with two sensors and a slide with two actuation contours in a sectional representation.

FIG. 2*a* shows a sectional representation, in particular, of the device from FIG. 1. It can be seen from the section that the two actuation contours 41, 42 are different shapes. The strength or phase of the actuation of an actuation element 7 (not shown) thus differ depending on which actuation contour is active.

The at least one sensor 6 in this embodiment comprises a first sensor 61 and a second sensor 62 arranged in the sensor unit 5. The sensors 61, 62 are arranged on a shared printed circuit board 11 and inside a shared housing 12.

Figure 2B:
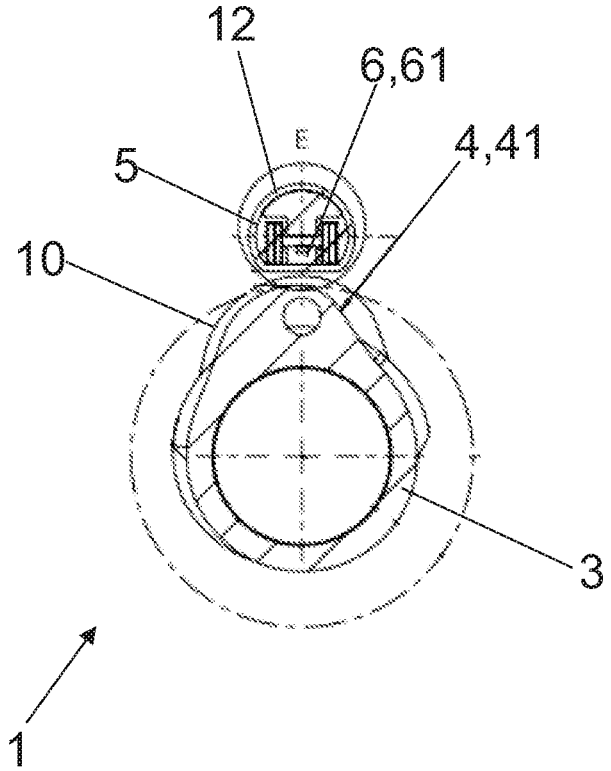
FIG. 2*b* shows the valve train device from FIG. 2*a* in an alternative sectional representation.

FIG. 2*b* shows an alternative sectional representation of the subject-matter from FIG. 2*a*. In this representation, the shape of the first actuation contour 41 is clearly visible.

In addition, the one or more actuation contour 10 therebehind can be seen, which is the same shape as the actuation contour 42, which is not visible. The actuation contour 42 has a different shape from the actuation contour 41 in the section; in particular, the radial extent is larger.

In this rotational position, the first actuation contour 41 is at the minimum distance from the first sensor 61, which is arranged in the sensor unit 5.

Due to the identical axial arrangement, the first actuation contour 41 lies in the sensing area 81 of the first sensor 61.

Figure 3:
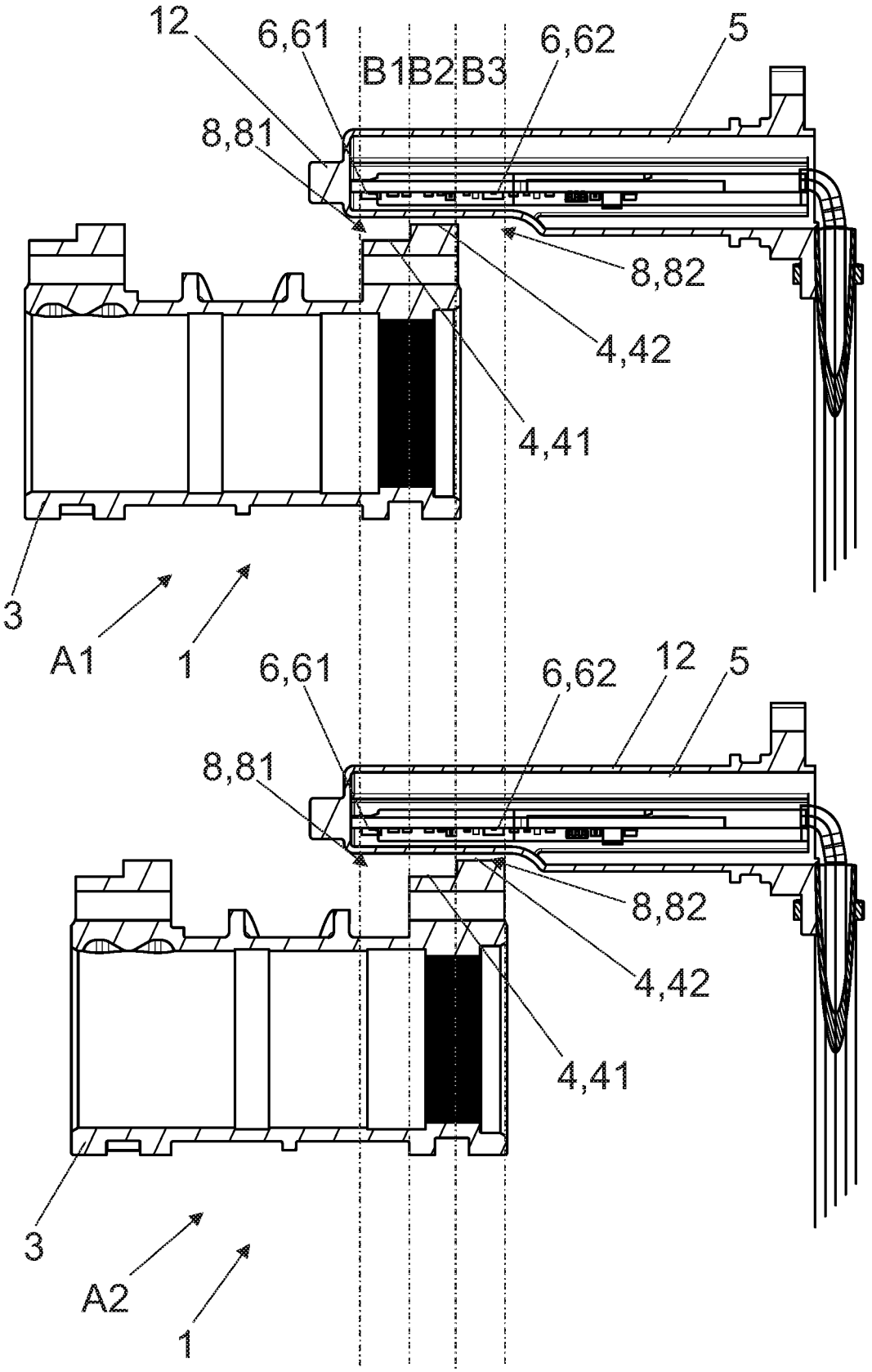
FIG. 3 shows a valve train device with a sensor unit with two sensors and a slide with two actuation contours, in a first and a second axial position.

FIG. 3 shows two axial positions A1 and A2 of the one or more actuation contours 4 (and of the slide 3) relative to the sensor unit 5. The sensor unit 5 is preferably arranged fixed in relation to a cylinder head of the internal combustion engine.

The upper representation shows the first axial position A1.

The first actuation contour 41 and the first sensor 61 are arranged in a first axial area B1. Thus, the first actuation contour 41 is in the sensing area 81 of the first sensor 61.

The second actuation contour 42 is in a second axial area B2. No sensor is arranged in this axial area B2. An actuation element 7 (not shown in FIG. 3) for actuating a valve of the internal combustion engine is arranged in the second axial area B2.

In the installed state, the second actuation contour 42 thus abuts the actuation element 7 in the first axial position A1, at least in one particular rotational position.

In the first axial position of the one or more actuation contours 4, no actuation contour is arranged in a third axial area B3. The sensor 62 which is arranged in this axial area B3 therefore does not detect any actuation contour 4.

The first axial position A1 is summarized as follows:

- the second actuation contour 42 is the active actuation contour that is in contact with the actuation element 7,
- the first sensor 61 detects the presence, and possibly the shape, phase and/or rotational position, of the first actuation contour 41, 20
- the second sensor 62 does not detect any actuation contour 4.

The lower representation in FIG. 3 shows the second axial position A2.

The first sensor 61 is arranged in the first axial area B1, as a result of which the first sensor 61 does not detect any actuation contour 4.

The first actuation contour 41 is arranged in a second axial area B2. No sensor is arranged in this axial area B2. An actuation element 7 (not shown in FIG. 3) for actuating a valve of the internal combustion engine is arranged in the second axial area B2.

In the installed state, the first actuation contour 41 thus abuts the actuation element 7 in the second axial position A2, at least in one particular rotational position.

In the second axial position A2, the second actuation contour 42 is arranged in a third axial area B3. The second sensor 62 which is arranged in this axial area B3 therefore detects the second actuation contour 42.

The second axial position A2 is summarized as follows:

- the first actuation contour 41 is the active actuation contour that is in contact with the actuation element 7,
- the second sensor 62 detects the presence, and possibly the shape, phase and/or rotational position, of the second actuation contour 42,
- the first sensor 61 does not detect any actuation contour 4.

In principle, only one of the sensors 61, 62 would be enough to determine the axial position A1, A2. Redundancy is created by the configuration having two sensors.

In an intermediate position (not shown) between the first axial position A1 and the second axial position A2, the first actuation contour 41 can protrude into the sensing area 81 of the first sensor 61 and the second actuation contour 42 can protrude into the sensing area 82 of the second sensor 62. Thus, both sensors 61, 62 can detect the presence of an actuation contour. If such a state is adopted not only during a brief switching process, the position is an incorrect position. The double detector signal can trigger an error message, or the engine can be stopped automatically.

The sensors 61, 62 are configured such that the spatial sensing area 81, 82 is arranged in a limited axial portion.

For example, the sensing area 81 of the sensor 61 or the sensing area 82 of the sensor 62 can include the axial areas B1 and B3, respectively. In particular, the sensing area 81 of the sensor 61 or the sensing area 82 of the sensor 62 should not protrude into the axial area B2.

In the radial direction, the sensing area 81 of the first sensor 61 and the sensing area 82 of the second sensor 62 are likewise limited, in particular such that at least one "lobe" of the actuation contour 41 or 42 can be detected.

The sensitivity of the sensors 61, 62 can be adapted to the particular dimensions, for example the minimum distance between the actuation contour and the sensor.

FIGS. 4*a* to 6*b* show schematic representations of different configurations of sensors 6, 61, 62 and actuation contours 4, 41, 42. In each case, the first axial position A1 is shown in the upper representation and the second axial position A2 is shown in the lower representation. The axial areas B1 and B2 (FIGS. 4*a* and 4*b*) or the axial areas B1, B2 and B3 (FIGS. 5*a* to 6*b*) are represented by dash-dot lines (the reference numbers are not indicated for the sake of clarity). An actuation element 7 for actuating a valve of an internal combustion engine is represented schematically as a pentagon.

Figure 6A:
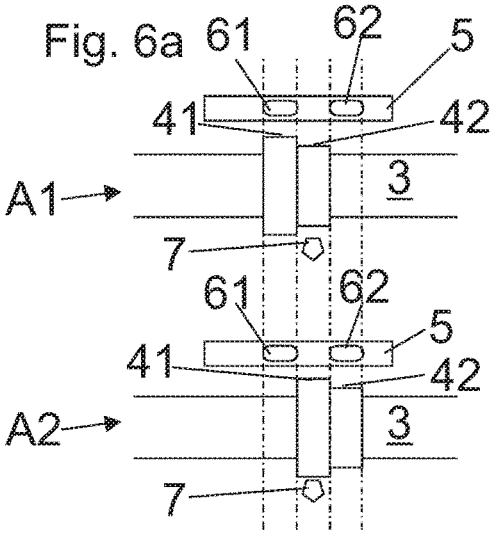
FIG. 6*a* is a schematic representation of a valve train device with two actuation contours and two spaced-apart sensors.

The configuration in FIG. 6*a* schematically represents the situation of FIG. 3.

Figure 4A:
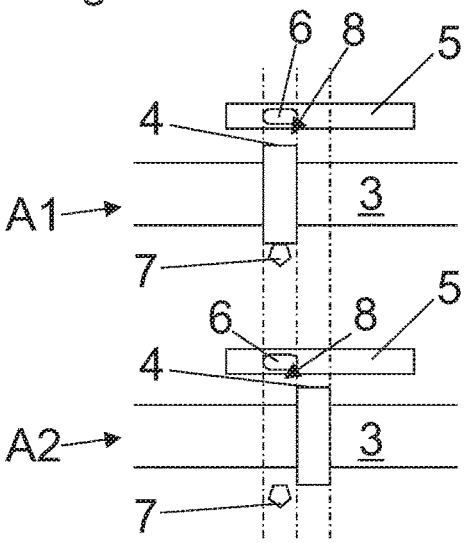
FIG. 4*a* is a schematic representation of a valve train device with an actuation contour and a sensor.

FIG. 4*a* shows an actuation contour 4 and a sensor 6, wherein the sensor 6 and the actuation element 7 are arranged in a first axial area B1.

In the first axial position A1, the actuation contour 4 is arranged in the first axial area B1, as a result of which the actuation contour 4 is arranged in the sensing area 8 of the sensor 6. The actuation contour 4 is active, i.e. is in engagement with the actuation element 7.

In the second axial position A2, the actuation contour 4 is arranged in the second axial area B2. Therefore, it is neither sensed by the sensor 6 nor active.

If an actuation contour 4 is detected by the sensor 6, the position is the first axial position A1. If no actuation contour 4 is detected, the position is the second axial position A2.

The rotational position, phase and/or shape of the actuation contour can be determined only when the actuation contour is active.

Figure 4B:
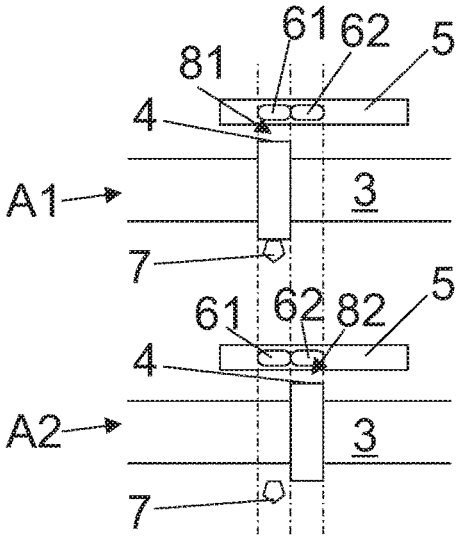
FIG. 4*b* is a schematic representation of a valve train device with an actuation contour and two sensors.

In FIG. 4*b*, an additional sensor 62 is arranged in the second axial area B2. Thus, the rotational position and/or the shape of the actuation contour 4 can be determined in both axial positions A1 and A2. In addition, an incorrect intermediate position can be detected if both sensors 61, 62 sense the presence of an actuation contour 4.

Using a displaceable actuation contour 4, an actuation element 7 can be actuated in a first axial position A1 and not actuated in a second axial position A2. The valve is thus not actuated in the second axial position A2 and remains constantly closed, for example.

Typically, a different actuation of the valve is desired. For this purpose, two actuation contours 41, 42 having different shapes from one another can be provided. The two actuation contours 41, 42 can be arranged directly adjacent to one another. This is the situation in FIGS. 5*a* to 6*b* and also FIGS. 1 to 3.

In FIGS. 5*a* to 6*b*, in the first axial position A1, the first actuation contour 41 is arranged in a first axial area B1 and the second actuation contour 42 is arranged in a second axial area B2. In the second axial position A2, the first actuation contour 41 is arranged in a second axial area B2 and the second actuation contour 42 is arranged in a third axial area B3. The second axial area B2 lies between the first and the third axial areas B1, B3.

The actuation element 7 is arranged in the central, second, axial area B2 such that the second actuation contour 42 is active in the first axial position A1 and the first actuation contour 41 is active in the second axial position A2.

Figure 5A:
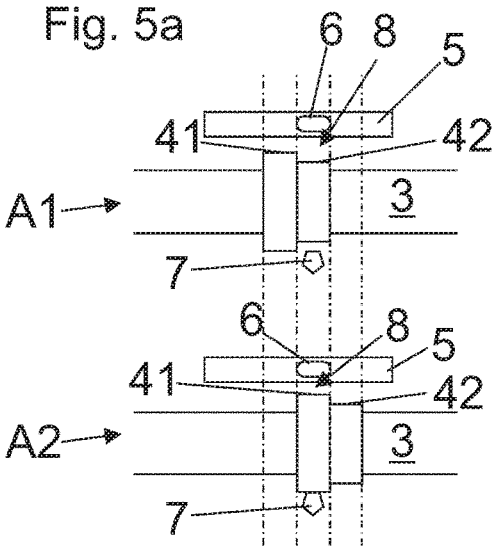
FIG. 5*a* is a schematic representation of a valve train device with two actuation contours and a central sensor.

FIG. 5*a* shows the situation with two actuation contours 41, 42 and one sensor 6. The sensor 6 is arranged in the second, central, axial area B2. Thus, the active actuation contour 41, 42 is sensed by the sensor 6 in each case.

In this configuration, the sensor 6 has to be able to distinguish between the two actuation contours 41, 42 in order to determine the axial position A1 or A2. This can be effected by evaluating the sensor signal, in particular by evaluating the pulse widths of the sensor signal. An incorrect intermediate position can in principle also be detected, although such a detection relies on complicated signal processing.

It is advantageous to make the determination of the axial position A1, A2 dependent on the sensing of the presence of an actuation contour 41, 42 and not for instance the shape thereof.

Figure 5B:
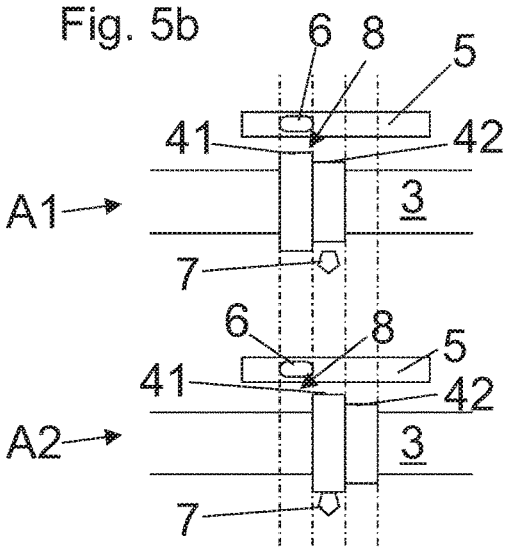
FIG. 5*b* is a schematic representation of a valve train device with two actuation contours and an off-center sensor.

In FIG. 5*b*, for this purpose the sensor 6 is arranged in the first axial area B1. In the first axial position A1, the sensor 6 senses the presence of the first actuation contour 41. In the second axial position A2, the sensor does not sense any actuation contour 42. Determining the axial position A1, A2 is thus simpler.

The disadvantage is that an incorrect intermediate position is difficult to detect and would require a complicated analysis of the signal. In addition, the sensing has no redundancy.

Accordingly, the particularly preferred embodiment of FIG. 6*a* provides two sensors 61, 62, wherein the sensors are arranged (spaced apart in an axial direction) at a distance from one another that is greater than the width of one actuation contour 41 or 42 and less than the width of both actuation contours 41 and 42. In particular, the first sensor 61 is arranged in the first axial area B1 and the second sensor 62 is arranged in the third axial area B3.

The statements made in relation to FIG. 3 apply here. This sensor arrangement allows the axial position A1, A2 to be determined with redundancy on the basis of a determination of the presence of actuation elements. In addition, an incorrect intermediate position can be detected on the basis of a determination of the presence of actuation elements.

If the first sensor 61 senses an actuation contour 4 and the second sensor 62 does not sense any actuation contour 4, the position is the first axial position A1. If the first sensor 61 does not sense any actuation contour 4 and the second sensor 62 senses an actuation contour 4, the position is the second axial position A2. Optionally, an incorrect intermediate position can be determined if both sensors 61, 62 sense an actuation contour 4.

Figure 6B:
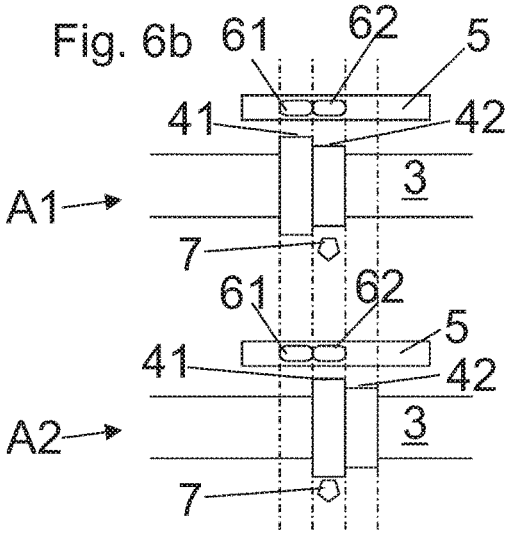
FIG. 6*b* is a schematic representation of a valve train device with two actuation contours and two off-center sensors.

FIG. 6*b* shows a further embodiment in which a first sensor 61 is arranged in a first axial area B1 and a second sensor 62 is arranged in a second axial area B2. An incorrect intermediate position cannot be readily determined by simply measuring the presence.

LIST OF REFERENCE NUMBERS

1 valve train device
2 spline
3 slide
4 actuation contour
  41 first actuation contour
  42 second actuation contour
5 sensor unit
6 sensor
  61 first sensor
  62 second sensor
7 actuation means
8 sensing area
  81 sensing area of the first sensor
  82 sensing area of the second sensor
9 selector gate
10 actuation contour that cannot be sensed
11 printed circuit board
12 housing
A1 first axial position
A2 second axial position
B1 first axial area
B2 second axial area
B3 third axial area

The invention claimed is:

1. A valve train device comprising:

a shaft;

one or more actuation contours for actuating an actuation element of a valve of a combustion engine, the one or more actuation contours being associated with the shaft so as to rotate with the shaft; and a sensor unit including at least two sensors, each of the at least two sensors having a spatial sensing area for sensing a physical variable, wherein the shaft, the one or more actuation contours, and the sensor unit are configured and arranged such that, in at least one axial position, an actuation contour of the one or more actuation contours is arranged at least partially in the spatial sensing area of a sensor of the at least two sensors, wherein the valve train device further comprises an evaluation unit configured to output an error message if at least two of the at least two sensors detect a presence of the actuation contour of the one or more actuation contours in their respective spatial sensing area over a predetermined period of time.

2. The valve train device according to claim 1, wherein the spatial sensing area of each sensor of the at least two sensors:

is arranged in a limited axial area, and/or corresponds to a spatial area in which a presence of the actuation contour of the one or more actuation contours induces a measurement of the physical variable above a predetermined threshold value.

3. The valve train device according to claim 1, wherein:

the valve train device further comprises a slide mounted on the shaft in an axially displaceable manner and so as to rotate with the shaft, wherein the one or more actuation contours are arranged on the slide, or the shaft is mounted displaceable in relation to the actuation element of the valve of a combustion engine, and the one or more actuation contours are arranged directly on the shaft.

4. The valve train device according to claim 1, wherein each actuation contour of the one or more actuation contours abuts the actuation element of the valve of the combustion engine in at least one axial position and in at least one rotational position.

5. The valve train device according to claim 1, wherein the sensor unit is fixed in relation to a cylinder head of the combustion engine.

6. The valve train device according to claim 1, wherein the at least two sensors are arranged on a shared printed circuit board of the sensor unit and/or are arranged in a shared housing of the sensor unit.

7. The valve train device according to claim 1, wherein the actuation contour of the one or more actuation contours is configured to be arranged at a distance of less than 10 mm from the sensor of the at least two sensors in at least one axial position and at least one rotational position.

8. The valve train device according to claim 7, wherein the actuation contour of the one or more actuation contours is configured to be arranged at a distance of less than 2.5 mm from the sensor of the at least two sensors in the at least one axial position and the at least one rotational position.

9. The valve train device according to claim 1, wherein each sensor of the at least two sensors is a contactless sensor and/or wherein each sensor of the at least two sensors is a magnetic-field sensor.

10. The valve train device according to claim 9, wherein the sensor of the at least two sensors is a Hall effect sensor configured such that a magnetic field generated by the actuation contour and/or influenced by the actuation contour is sensed in the spatial sensing area by the sensor.

11. The valve train device according to claim 1, wherein each sensor of the at least two sensors is configured to detect in the spatial sensing area a presence, a shape, a rotational position, and/or a phase of the actuation contour of the one or more actuation contours.

12. The valve train device according to claim 11, wherein the evaluation unit is further configured to evaluate the physical variable that varies based on the presence, the shape, the rotational position, and/or the phase of the actuation contour of the one or more actuation contours detected by the sensor.

13. The valve train device according to claim 1, wherein each sensor of the at least two sensors is configured to measure the physical variable that varies based on a presence, a shape, a phase, and/or a rotational position of the actuation contour located in the spatial sensing area.

14. The valve train device according to claim 13, wherein a signal dependent on the physical variable is transmitted to the evaluation unit, and the evaluation unit is configured to evaluate the signal.

15. The valve train device according to claim 14, wherein the signal is an electrical signal, and the evaluation unit is configured to evaluate a time curve of the electrical signal.

16. The valve train device according to claim 1, wherein the evaluation unit is further configured to determine an axial position and/or a rotational position and/or a phase of the actuation contour of the one or more actuation contours.

17. The valve train device according to claim 16, where the evaluation unit is configured to determine the axial position and/or the rotational position and/or the phase of the actuation contour by evaluating a strength and/or pulse lengths of the signal of the at least two sensors.

18. The valve train device according to claim 1, wherein the one or more actuation contours comprise at least two adjacent actuation contours, and wherein:

an axial distance between two sensors of the at least two sensors is greater than an axial width of at least one actuation contour of the at least two adjacent actuation contours; and an axial distance between two sensors of the at least two sensors is less than an axial width of two adjacent actuation contours of the at least two adjacent actuation contours.

19. The valve train device according to claim 1, wherein the one or more actuation contours are configured to adopt a first axial position and a second axial position relative to the sensor unit.

20. The valve train device according to claim 19, wherein the at least two sensors comprises a first sensor having a first spatial sensing area and a second sensor having a second spatial sensing area, and the one or more actuation contours comprises a first actuation contour and a second actuation contour, and wherein:

(i) in the first axial position, the first actuation contour is located in the first spatial sensing area of the first sensor, and/or the second actuation contour is located outside the second spatial sensing area of the second sensor, and/or (ii) in the second axial position, the second actuation contour is located in the second spatial sensing area of the second sensor, and/or the first actuation contour is located outside the first spatial sensing area of the first sensor.

21. The valve train device according to claim 19, wherein the one or more actuation contours comprises a first actuation contour and a second actuation contour, and in at least one rotational position, the second actuation contour abuts the actuation element in the first axial position and/or the first actuation contour abuts the actuation element in the second axial position.

22. The valve train device according to claim 1, wherein the one or more actuation contours comprises a first actuation contour and a second actuation contour.

23. The valve train device according to claim 22, wherein a shape of the first actuation contour is different from a shape of the second actuation contour.

24. The valve train device according to claim 1, wherein a first sensor and a second sensor of the at least two sensors are arranged such that a first spatial sensing area of the first sensor and a second spatial sensing area of the second sensor occupy different spatial areas and do not overlap.

25. A combustion engine comprising:

a valve; and the valve train device according to claim 1, wherein the valve train device is configured to actuate the valve using the actuation element.

26. A motorcycle comprising the combustion engine according to claim 25.

27. A method of controlling a combustion engine by determining an axial and/or a rotational position of an actuation contour of one or more actuation contours for actuating an actuation element of a valve of a combustion engine using the valve train device according to claim 1, the method comprising:

detecting the physical variable using a sensor of the at least two sensors, the physical variable being influenced by the actuation contour located in the spatial sensing area of the sensor;

emitting a signal from the sensor based on the detected physical variable to the evaluation unit;

evaluating the signal using the evaluation unit;

determining the axial and/or the rotational position of the actuation contour based on the evaluated signal, and controlling the combustion engine using the axial and/or the rotational position of the actuation contour determined based on the evaluated signal.

28. The method according to claim 27, wherein the physical variable is a magnetic field influenced by a presence, a shape, a phase, and/or a rotational position of the actuation contour located in the spatial sensing area of the sensor of the at least two sensors, the signal emitted by the sensor being an electrical signal, and the evaluation unit being configured to evaluate a strength and/or a pulse length of the electrical signal.

29. A valve train device comprising:

a shaft;

one or more actuation contours for actuating an actuation element of a valve of a combustion engine, the one or more actuation contours being associated with the shaft so as to rotate with the shaft; and a sensor unit including one or more sensors, each of the one or more sensors having a spatial sensing area for sensing a physical variable, wherein the shaft, the one or more actuation contours, and the sensor unit are configured and arranged such that, in at least one axial position, an actuation contour of the one or more actuation contours is arranged at least partially in the spatial sensing area of a sensor of the one or more sensors, wherein the one or more actuation contours are configured to adopt a first axial position and a second axial position relative to the sensor unit, wherein, in the first axial position, the actuation contour of the one or more actuation contours is arranged in the spatial sensing area of the sensor of the one or more sensors and, in the second axial position, the actuation contour of the one or more actuation contours is arranged outside the spatial sensing area of the sensor.

30. A valve train device comprising:

a shaft;

one or more actuation contours for actuating an actuation element of a valve of a combustion engine, the one or more actuation contours being associated with the shaft so as to rotate with the shaft; and a sensor unit including one or more sensors, each of the one or more sensors having a spatial sensing area for sensing a physical variable, wherein the shaft, the one or more actuation contours, and the sensor unit are configured and arranged such that, in at least one axial position, an actuation contour of the one or more actuation contours is arranged at least partially in the spatial sensing area of a sensor of the one or more sensors, wherein the one or more sensors comprises a first sensor having a first spatial sensing area and a second sensor having a second spatial sensing area, wherein, in a first axial position, the actuation contour of the one or more actuation contours is arranged in the first spatial sensing area of the first sensor and, in a second axial position, the actuation contour of the one or more actuation contours is arranged in the second spatial sensing area of the second sensor.

31. A valve train device comprising:

a shaft;

one or more actuation contours for actuating an actuation element of a valve of a combustion engine, the one or more actuation contours being associated with the shaft so as to rotate with the shaft; and a sensor unit including one or more sensors, each of the one or more sensors having a spatial sensing area for sensing a physical variable, wherein the shaft, the one or more actuation contours, and the sensor unit are configured and arranged such that, in at least one axial position, an actuation contour of the one or more actuation contours is arranged at least partially in the spatial sensing area of a sensor of the one or more sensors, wherein the one or more actuation contours comprises a first actuation contour and a second actuation contour, wherein, in a first axial position, the second actuation contour is arranged in the spatial sensing area of the sensor of the one or more sensors, and in a second axial position, the first actuation contour is arranged in the spatial sensing area of the sensor of the one or more sensors.

* * * * *